US005375446A

United States Patent [19]

Hein

[11] Patent Number: 5,375,446

[45] Date of Patent: Dec. 27, 1994

[54] ROTARY EXPANDED GRID CUTTER AND RELATED PROCESS

[75] Inventor: Edward R. Hein, Mohnton, Pa.

[73] Assignee: Exide Corporation, Reading, Pa.

[21] Appl. No.: 143,785

[22] Filed: Nov. 1, 1993

[51] Int. Cl.[5] ..... B21D 31/04

[52] U.S. Cl. ..... 72/186; 29/6.1

[58] Field of Search ..... 72/186; 29/6.1

[56] References Cited

U.S. PATENT DOCUMENTS 3,760,470 9/1973 Felsenthal .
4,291,443 9/1981 Laurie et al. .
4,297,866 11/1981 Sakauye et al. .
4,315,356 2/1982 Laurie et al. .
5,093,971 3/1992 Hein .
5,239,735 8/1993 Tanaka et al. ..... 29/6.1

*Primary Examiner*—Lowell A. Larson
*Attorney, Agent, or Firm*—Nixon & Vanderhye

[57] ABSTRACT

In a method of forming expanded metal mesh from a deformable strip which includes the steps of preforming and slitting the strip by intermeshing tooth segments of at least an upper disk and a lower disk with the strip passing therebetween, wherein the tooth segments each include linear leading and trailing surfaces joined at an apex defining a nose angle, and intersecting respective tangents to a radius of the disk at circumferentially spaced locations defining entry and exit angles, respectively, an improvement which includes selecting the exit angle in accordance with the formula:

$$\text{exit angle} = 45^\circ - \frac{1}{2}\left[\cos^{-1}\left(\frac{R}{R + (D - T)}\right)\right]$$

where
R=radius of tooth root;
D=depth of tooth; and
T=strip thickness.

11 Claims, 4 Drawing Sheets

ROTARY EXPANDED GRID CUTTER AND RELATED PROCESS

This invention relates to improvements to conventional rotary expanded battery grid processes and, specifically, to a cutter tool configuration which produces a sufficiently thin mesh to allow pasting to a required weight.

BACKGROUND AND SUMMARY OF THE INVENTION

Electrodes of battery cells often comprise an expanded metal sheet, the openings and surfaces of which carry a chemically active powder. A method and apparatus for producing an expanded grid is disclosed in U.S. Pat. No. 3,760,470. U.S. Pat. No. 4,291,443 discloses a conventional three roll cluster (where the strip passes between first and second rolls in a preforming/-slitting stage, and then between the second and a third roll in a final slitting stage) for preforming and slitting a sheet to produce an expanded metal mesh, the entirety of which is incorporated herein by reference. U.S. Pat. No. 4,297,866 discloses an improved process for producing expanded metal sheet by concurrently slitting and preforming the strip. In a preferred arrangement in the '866 patent, the length of one side of a triangle corresponding to the tooth configuration, and collinear with the leading tooth surface, is less than the length of another side of the triangle corresponding to and collinear with the trailing tooth surface. In this same triangle, the entry angle formed between the side of the triangle corresponding to the leading surface and the base of the triangle is less than 90°. In other words, the convexly shaped tooth surfaces used to deform slit segments out of the plane of the sheet or strip are asymmetrically shaped. Problems have been experienced with asymmetrical cutters, however. For example, when mesh is required to be flattened to within 0.015–0.012" of the strip thickness, and the top wires are very heavy (0.050–0.060") as required for positive grids with high conductivity, the "short" leg of the tooth segment or surface develops a kink when flattened. This kink prevents the mesh from being uniformly thin and often causes jams, resulting in stoppages in the paster apparatus. Precision pasting to the required weight thus becomes problematic.

I have now discovered that forming the cutter tooth with a symmetrical shape makes the mesh easier to flatten. One of the problems, however, with choosing the correct angle for the cutter "triangle" relates to the permissible elongation of the lead strip. Experience has shown that 45° is the maximum entry angle. When this is translated into a rotary process, allowance must be made for the fact that the tool rotates and the leading edge is reduced, and the trailing angle (as defined between the base of the triangle and the trailing surface of the tooth) is increased by the angle between vertical and when the tool first enters the lead strip. If the trailing angle becomes too large, excessive elongation will result. The '866 patent purports to make this allowance by utilizing asymmetrical surfaces, but this results in the problem mentioned above.

In accordance with this invention, a two or three roll cluster is utilized, with the geometry of the cutter teeth for the roll pair which performs the strip based on calculations when the tool exits the strip. For purposes of this invention, in terms of its incorporation in a three roll cluster, the focus is on the interaction of the first and second rolls, i.e., during the preforming/slitting stage, while the interaction between the second and third rolls in the final slitting stage forms no part of this invention. The trailing edge angle of the tooth is always less than 45°, and is determined as a function of the radius of the tooth root, the depth of the tooth and the thickness of the strip. The entry angle is then made equal to the trailing angle, and therefore it follows that the nose angle (the angle between the leading and trailing surfaces, at the apex of the tooth) is always greater than 90°.

In its broader aspects, therefore, this invention relates to an improvement in a method of forming expanded metal sheet from a deformable strip comprising preforming and slitting the strip by intermeshing tooth segments of at least an upper disk and a lower disk with the strip passing therebetween, wherein the tooth segments each include linear leading and trailing surfaces joined at an apex defining a nose angle, said leading and trailing surfaces intersecting respective tangents to a radius of the roll at circumferentially spaced locations defining entry and exit angles, respectively, and wherein the exit angle is selected in accordance with the formula:

$$\text{exit angle} = 45° - \frac{1}{2}\left[\cos^{-1}\left(\frac{R}{R + (D - T)}\right)\right]$$

where

R=radius of tooth root;

D=depth of tooth: and

T=strip thickness.

In a related aspect, the invention relates to an improvement in a method of forming expanded metal sheet from a deformable strip comprising preforming and slitting the strip by intermeshing tooth segments of at least an upper disk and a lower disk with the strip passing therebetween, wherein the tooth segments each include linear leading and trailing surfaces joined at an apex defining a nose angle, said leading and trailing surfaces intersecting respective tangents to a radius of the disk at circumferentially spaced locations defining entry and exit angles, respectively, and wherein the entry angle is selected in accordance with the formula:

$$\text{entry angle} = 45° - \frac{1}{2}\left[\cos^{-1}\left(\frac{R}{R + (D - T)}\right)\right]$$

where

R=radius of tooth root;

D=depth of tooth; and

T=strip thickness..

The above described tool and related method produce a uniformly thin, expanded metal product for use as a battery grid that may be accurately pasted to the required weight.

Additional objects and advantages of the subject invention will become apparent from the detailed description which follows.

BRIEF DESCRIPTION THE DRAWINGS

DETAILED DESCRIPTION OF THE DRAWINGS

Figure 1:
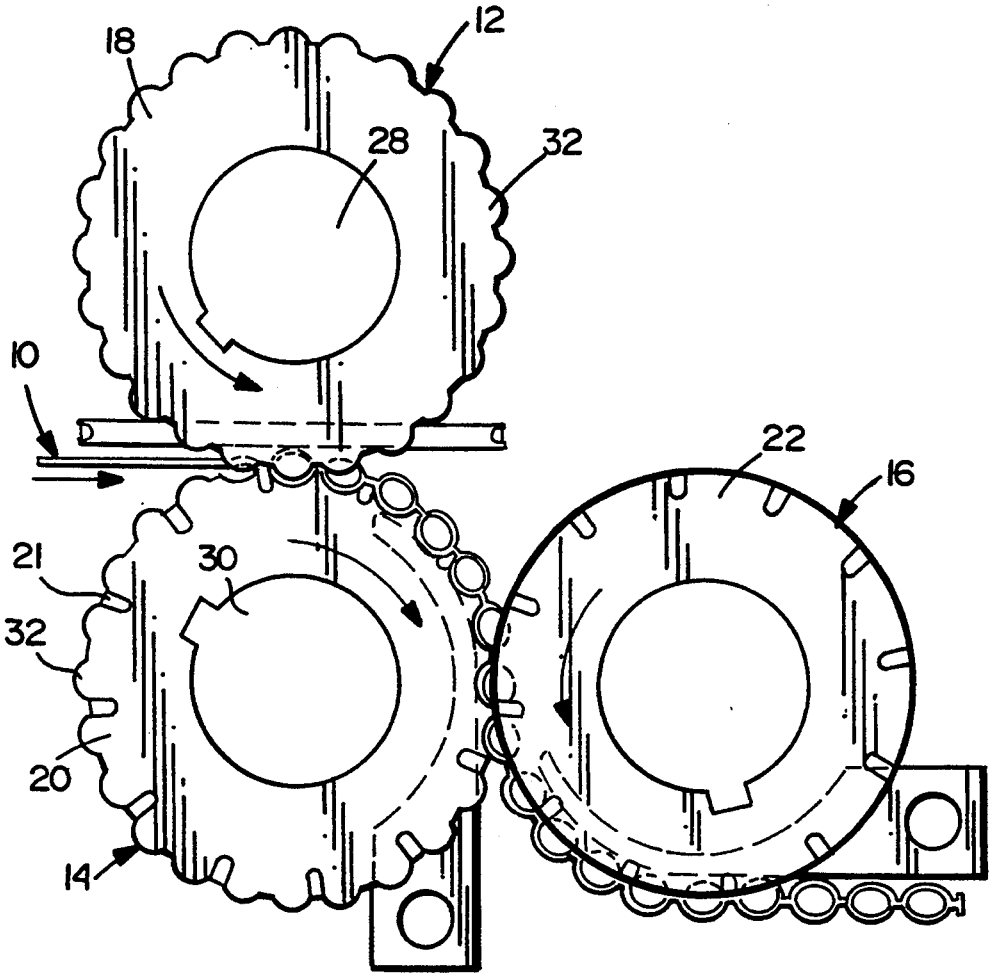
Fig. 1 PRIOR ART
FIG. 1 is a side elevation of a conventional three roll cluster used to preform and then slit a metal sheet.
Figure 3:
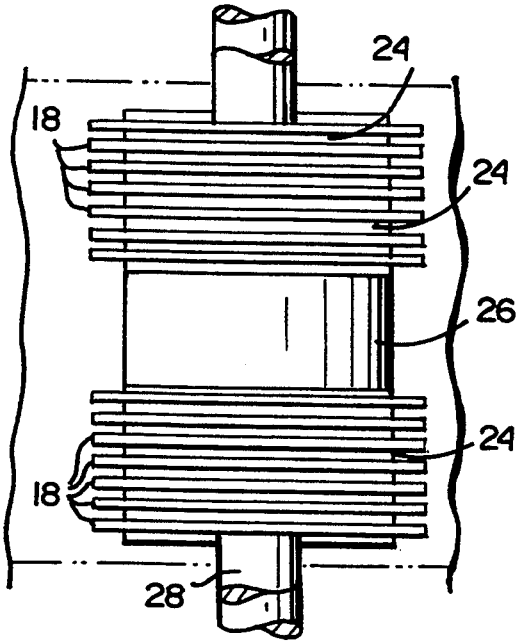
Fig. 3 PRIOR ART
FIG. 3 is a schematic plan view of a conventional upper disk of the type used in the roll cluster shown in FIG. 1.

With reference to FIG. 1, a strip 10 enters the cluster of three rolls 12, 14 and 16, each roll having a plurality of spaced disks 18, 20, 22, respectively. The disks of each roll are separated by spacers 24, and possibly other spacers such as that shown at 26, depending on the configuration of the sheet, as best seen in FIG. 3. The first and second sets of disks 18 and 20 have toothed peripheral edges, laterally aligned by keying the disks 18 and 20 to the respective shafts 28, 30. These first and second sets of disks 18 and 20 have teeth 32 with identical tooth profiles. In this regard, the lower roll disks 20 have cutting edges 21 between each pair of teeth 32, but the tooth profiles themselves are identical to those of the roll disks 18.

Figure 2:
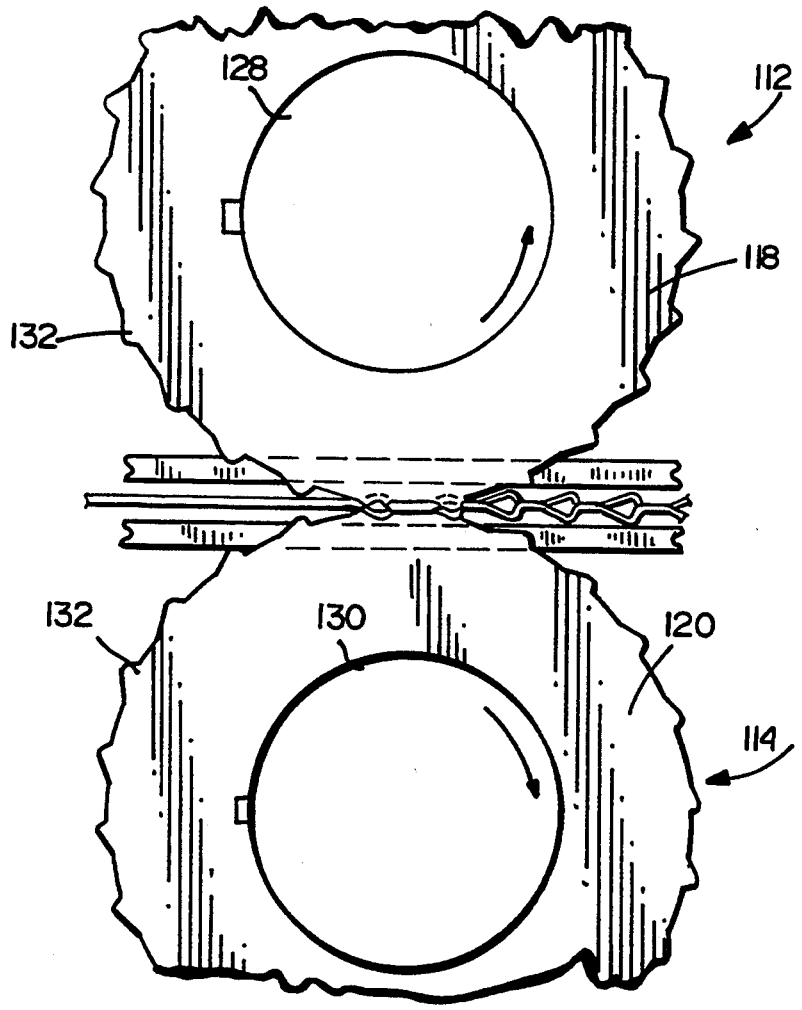
Fig. 2 PRIOR ART
FIG. 2 is a side elevation of a conventional two roll cluster used to concurrently deform and slit a metal sheet.

The disk/spacer arrangement on upper and lower disk rolls 12 and 14 involves a lateral offset so that the disks 18 intermesh with the disks 20, i.e., the disks 18 of the upper roll 12 fit within the spaces between the disks 20 of the lower roll 14. These preforming disk rolls 12 and 14 form aligned side-by-side projections in alternating up and down relationship, as shown in FIGS. 1 and 2. The preformed/slit sheet 10 is then introduced between second and third rolls 14 and 16 where the final slitting of the sheet occurs, but, again, this aspect of the process forms no part of this invention. Rather, this invention is concerned with the tooth configuration of the sets of disks 18, 20 which make up the first and second rolls 12, 14, respectively.

FIG. 2 illustrates upper and lower rolls 112 and 114 of the type disclosed in U.S. Pat. No. 4,297,866. A plurality of disks 118 are laterally spaced on shaft 128 for intermeshing engagement with a plurality of offset disks 120, laterally spaced on shaft 130. As discussed hereinabove, the asymmetrically shaped teeth 132 have proved problematic in that it is difficult to obtain uniformly thin finished sheets.

Figure 4:
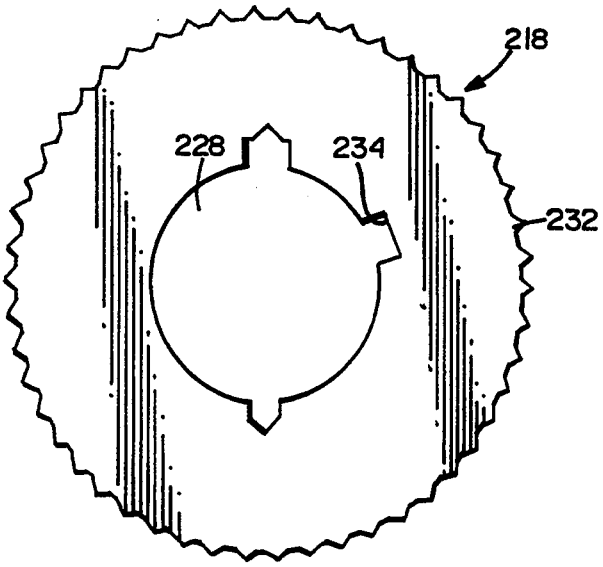
FIG. 4 is a side elevation of an upper preforming disk in accordance with this invention.

Turning now to FIG. 4, an upper preforming roll disk 218, in accordance with this invention (for use in place of disk 18), is shown to include a plurality of peripheral teeth 232, as well as a keyway 234 to enable the disk to be slidably mounted on a shaft 228 so as to precisely align a plurality of such disks 218 in side-by-side relation, with the apex of each tooth 232 aligned in rows extending parallel to the axis of the shaft 228.

It will be understood that a lower roll of the roll pair is formed with identical teeth.

Figure 5:
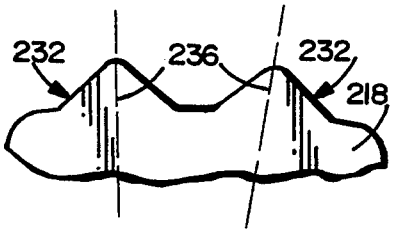
FIG. 5 is an enlarged detail taken from the disk of FIG. 4.

FIG. 5 shows individual teeth 232 in enlarged form, and specific note is made of the symmetrical configuration of each tooth about a tooth center line 236.

Figure 6:
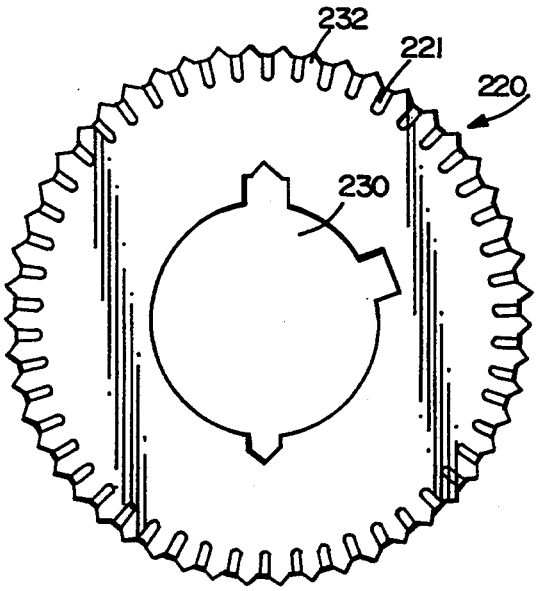
FIG. 6 is a side elevation of an upper preforming/slitting disk of the type employed as the lower roll in the three roll cluster of FIG. 1 but wherein the teeth of the disk are formed in accordance with this invention.

FIG. 6 illustrates a preform/sitter disk 220 having a plurality of peripheral teeth 232 separated by slots 221. These slots 221 are intended to facilitate the slitting operation as roll 214 cooperates with a third roll in the cluster, such as that shown generally at 16 in FIG. 1.

Figure 7:
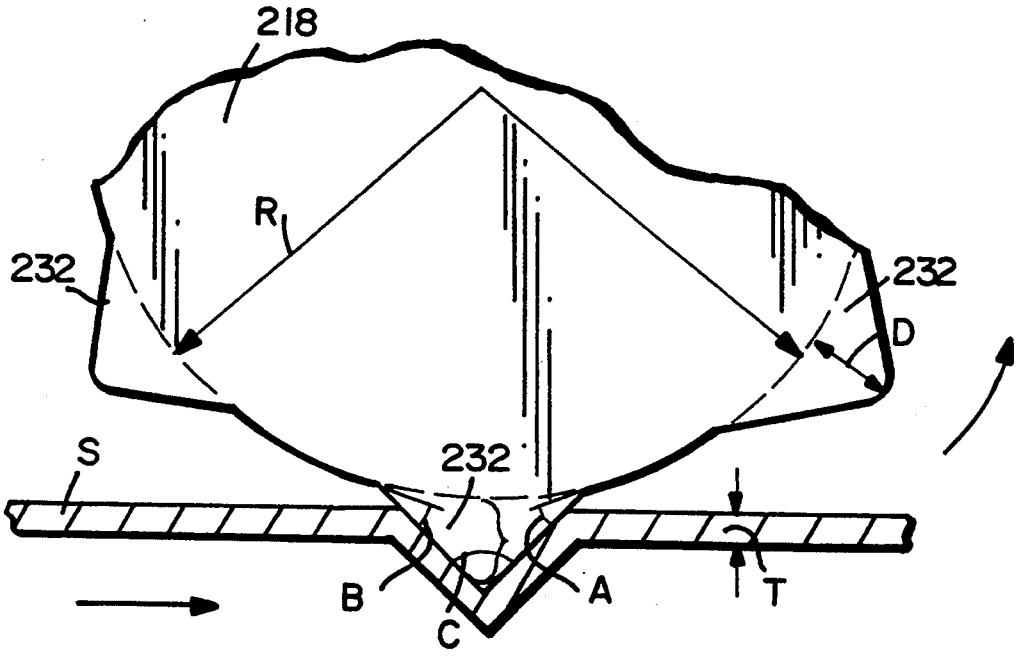
FIG. 7 is a partial, enlarged detail of the disk illustrated in FIG. 5.

Turning now to FIG. 7, the roll disk 218 is shown with one tooth 232 at maximum penetration of the strip S. From the conventional arrangement shown in FIG. 1, it will be appreciated that at the same time, an identical tooth of the lower roll has reached a point of maximum penetration in the opposite direction at alternate locations along the axes of the shafts or rolls as shown and described in the '443 patent. Assuming a counterclockwise direction of rotation for the upper roll, and with the strip S moving from left to right in the direction indicated by the arrow, an entry angle A is defined by an entry surface of the tooth 232 and a tangent to the disk surface at a point of intersection of the tooth surface with the disk. A similar angle B is defined on the trailing side of the tooth 232 while a nose angle C is defined by the intersection of the tooth surfaces at the apex of the tooth.

In accordance with this invention, a determination of the exit angle B can be calculated from the following formula:

$$\text{angle } B = 45^\circ - \frac{1}{2}\left[\cos^{-1}\left(\frac{R}{R + (D - T)}\right)\right]$$

where

R = the radius of the tooth root;

D = the depth of the tooth; and

T = strip thickness.

Because it has been determined that the cutting tooth 232 should be symmetrical, it follows that the entry angle A will equal the exit angle B. As will also be appreciated, since both the entry and exit angles A and B, respectively, are less than 45°, the nose angle C will be greater than 90°. Thus, if the entry and exit angles are, for example 42°, the nose angle will be 96°.

While it has been found that using the exit angle B as the basis for the calculation of angles A and C results in a superior product, calculations based on the entry angle A should yield similar results.

Subsequent steps in the forming process, including final slitting by the interaction of the second and third rolls, and subsequent expansion of the strip may be achieved as in conventional processes, such as described in the '443 patent and need not be described in detail here.

In practice, I have found that cutter teeth formed in accordance with the above calculations produce metal mesh strip which does not experience excessive elongation as in the past. As a result, the strip is more easily flattened to the required tolerance, and the subsequent pasting process may be carried out to achieve the required weight with greater precision.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a method of forming expanded metal mesh from a deformable strip comprising preforming and slitting said strip by intermeshing tooth segments of at least an upper disk and a lower disk with said strip passing therebetween, wherein said tooth segments each include linear leading and trailing surfaces joined at an apex defining a nose angle, said leading and trailing surfaces intersecting respective tangents to a radius of the disk at circumferentially spaced locations defining entry and exit angles, respectively, the improvement comprising selecting said exit angle in accordance with the formula:

$$\text{exit angle} = 45° - \frac{1}{2}\left[\cos^{-1}\left(\frac{R}{R + (D - T)}\right)\right]$$

where

R=radius of tooth root;

D=depth of tooth; and

T=strip thickness.

2. The method of claim 1 wherein said nose angle is always greater than 90°.

3. The method of claim 1 wherein the nose angle is chosen in accordance with the formula:

$$\text{nose angle} = 90° + \cos^{-1}\left(\frac{R}{R + (D - T)}\right).$$

4. The method of claim 1 and including the step of arranging a plurality of said upper disks on a first shaft in generally side-by-side relationship with spacers therebetween.

5. The method of claim 4 and including the step of arranging a plurality of said lower disks on a second shaft in generally side-by-side relationship with spacers therebetween, wherein said lower disks are arranged axially on said second shaft in vertical alignment with said spacers on said first shaft.

6. The method of claim 1 wherein said linear leading and trailing surfaces have substantially equal lengths.

7. In a method of forming expanded metal mesh from a deformable strip comprising preforming and slitting said strip by intermeshing tooth segments of at least an upper disk and a lower disk with said strip passing therebetween, wherein said tooth segments each include linear leading and trailing surfaces joined at an apex defining a nose angle, said leading and trailing surfaces intersecting respective tangents to a radius of the disk at circumferentially spaced locations defining entry and exit angles, respectively, the improvement comprising selecting said entry angle in accordance with the formula:

$$\text{entry angle} = 45° - \frac{1}{2}\left[\cos^{-1}\left(\frac{R}{R + (D - T)}\right)\right]$$

where

R=radius of tooth root;

D=depth of tooth; and

T=strip thickness.

8. The method of claim 7 wherein said nose angle is always greater than 90°.

9. The method of claim 7 wherein the nose angle is chosen in accordance with the formula:

$$\text{nose angle} = 90° + \cos^{-1}\left(\frac{R}{R + (D - T)}\right).$$

10. The method of claim 7 and including the step of arranging a plurality of upper disks on a first shaft in generally side-by-side relationship with spacers therebetween.

11. The method of claim 7 and including the step of arranging a plurality of lower disks on a second shaft in generally side-by-side relationship with spacers therebetween, wherein said lower disks are arranged axially on said second shaft in vertical alignment with said spacers on said first shaft.

* * * * *